US009508509B2

(12) United States Patent
Kashimura et al.

(10) Patent No.: US 9,508,509 B2
(45) Date of Patent: Nov. 29, 2016

(54) CONTACT DEVICE HAVING ARC ROOT MOVEMENT PROMOTION PORTION, AND ELECTROMAGNETIC SWITCH IN WHICH THE CONTACT DEVICE IS USED

(71) Applicants: FUJI ELECTRIC FA COMPONENTS & SYSTEMS CO., LTD., Chuo-ku, Tokyo (JP); FUJI ELECTRIC CO., LTD., Kawasaki-shi, Kanagawa (JP)

(72) Inventors: Osamu Kashimura, Hino (JP); Masaru Isozaki, Ichihara (JP); Kouetsu Takaya, Kounosu (JP); Yuji Shiba, Kounosu (JP)

(73) Assignees: FUJI ELECTRIC FA COMPONENTS & SYSTEMS CO., LTD., Tokyo (JP); FUJI ELECTRIC CO., LTD., Kawasaki-Shi (JP)

( * ) Notice: Subject to any disclaimer, the term of this patent is extended or adjusted under 35 U.S.C. 154(b) by 127 days.

(21) Appl. No.: 14/505,680

(22) Filed: Oct. 3, 2014

(65) Prior Publication Data

US 2015/0022291 A1 Jan. 22, 2015

Related U.S. Application Data

(63) Continuation of application No. PCT/JP2013/002474, filed on Apr. 11, 2013.

(30) Foreign Application Priority Data

Apr. 13, 2012 (JP) ..... 2012-092451

(51) Int. Cl.
*H01H 33/20* (2006.01)
*H01H 9/44* (2006.01)

(Continued)

(52) U.S. Cl.
CPC ..... *H01H 33/20* (2013.01); *H01H 1/06* (2013.01); *H01H 3/28* (2013.01); *H01H 9/443* (2013.01);

(Continued)

(58) Field of Classification Search
CPC ..... H01H 9/443; H01H 9/46; H01H 50/546; H01H 1/06; H01H 33/182; H01H 33/20; H01H 73/045; H01H 50/38; H01H 3/28; H01H 2050/025
See application file for complete search history.

(56) References Cited

U.S. PATENT DOCUMENTS 5,519,370 A 5/1996 Perreira et al.
5,546,061 A 8/1996 Okabayashi et al.

(Continued)

FOREIGN PATENT DOCUMENTS

EP 0715326 A2 6/1996
JP 3733537 B 11/2000

(Continued)

OTHER PUBLICATIONS

PCT, "International Search Report for International Application No. PCT/JP2013/002474".

(Continued)

*Primary Examiner* — Bernard Rojas
(74) *Attorney, Agent, or Firm* — Manabu Kanesaka

(57) ABSTRACT

A contact device includes a pair of fixed contacts fixedly disposed inside an arc extinguishing chamber and maintaining a predetermined interval from each other; a movable contact disposed to contact to and separate from the pair of fixed contacts; and an arc root movement promotion portion formed on the movable contact to promote a movement of root of arc in a direction away from the fixed contacts. The root of arc is generated when the movable contacts are opened and separated from the pair of fixed contacts.

10 Claims, 12 Drawing Sheets

(51) Int. Cl.

| | |
|---|---|
| ***H01H 9/46*** | (2006.01) |
| ***H01H 50/54*** | (2006.01) |
| ***H01H 1/06*** | (2006.01) |
| ***H01H 3/28*** | (2006.01) |
| ***H01H 33/18*** | (2006.01) |
| ***H01H 73/04*** | (2006.01) |
| ***H01H 50/38*** | (2006.01) |
| *H01H 50/02* | (2006.01) |

(52) U.S. Cl.

CPC ..... *H01H 9/46* (2013.01); *H01H 33/182* (2013.01); *H01H 50/38* (2013.01); *H01H 50/546* (2013.01); *H01H 73/045* (2013.01); *H01H 2050/025* (2013.01)

(56) References Cited

U.S. PATENT DOCUMENTS

| | | | |
|---|---|---|---|
| 5,680,084 | A | 10/1997 | Kishi et al. |
| 2010/0289604 | A1 | 11/2010 | Kojima et al. |

FOREIGN PATENT DOCUMENTS

| | | | |
|---|---|---|---|
| JP | 2002-334644 | A | 11/2002 |
| JP | 2006-019148 | A | 1/2006 |

OTHER PUBLICATIONS

Europe Patent Office, "Search Report for EP 13776087.2," Dec. 15, 2015.

CONTACT DEVICE HAVING ARC ROOT MOVEMENT PROMOTION PORTION, AND ELECTROMAGNETIC SWITCH IN WHICH THE CONTACT DEVICE IS USED

CROSS REFERENCE

The present application is a continuation application of an International Application No. PCT/JP2013/002474 filed Apr. 11, 2013, and claims priority from Japanese Application No. 2012-092451 filed Apr. 13, 2012.

TECHNICAL FIELD

The present invention relates to a contact device including fixed contacts and a movable contact inserted in a current path, and to an electromagnetic switch in which the contact device is used, wherein an arc generated when the contacts of the fixed contacts and movable contact are opened, that is, when current is interrupted, is easily extinguished.

BACKGROUND ART

Conventionally, various kinds of contact mechanism that, in an electromagnetic relay, electromagnetic contactor, or the like, extinguish an arc generated when contacts are opened to cause a movable contact to move away from a fixed contact in order to change from a closed condition of the contact mechanism, wherein the fixed contact and movable contact are contacting each other, to an opened condition by interrupting the current have been proposed as a contact device wherein switching of a current path is carried out.

For example, an electromagnetic switching device including a pair of fixed contacts, each having a fixed contact point, disposed to be separated by a predetermined distance from each other, a movable contact having a movable contact point at the left and right ends thereof, disposed so as to be capable of contacting to and separating from the pair of fixed contacts, an electromagnet device driving the movable contact, and an enclosing member that houses the movable contact and fixed contacts, wherein an arc extinguishing permanent magnet is disposed parallel with the movable contact on the outer side of the enclosing member, has been proposed (for example, refer to PTL 1).

CITATION LIST

Patent Literature

PTL 1: JP-A-2006-19148

SUMMARY OF INVENTION

Technical Problem

However, the heretofore known example described in PTL 1 is such that, although the arc is extended by the magnetic force of the permanent magnet and thus easily extinguished, the root of an arc generated when the current is interrupted, that is, when the contacts are opened, causing the movable contact to move away from an engaged condition wherein the movable contact contacts the fixed contacts, and moves along the movable contact point of the movable contact to an arc extinguishing space side due to the magnetic force of the permanent magnet. There is an unresolved problem of a decrease in interruption performance due to the moving arc root remaining in a corner portion of the movable contact, a decrease in electrical field intensity occurring due to a metal vapor, or the like, emitted from the arc root, and the arc being repeatedly regenerated, or the like.

Therefore, the invention, having been contrived focusing on the unresolved problem of the heretofore known example, has an object of providing a contact device, and an electromagnetic switch in which the contact device is used, such that an arc generated between a fixed contact and a movable contact when the contacts are opened can be easily extinguished.

Solution to Problem

In order to achieve the heretofore described object, a first aspect of a contact device according to the invention includes a pair of fixed contacts fixedly disposed maintaining a predetermined interval inside an arc extinguishing chamber, and a movable contact disposed so as to be capable of contacting to and separating from the pair of fixed contacts inside the arc extinguishing chamber. Further, an arc root movement promotion portion that promotes movement in a direction away from the fixed contacts of the root of an arc generated when the contacts are opened and the movable contact separates from the pair of fixed contacts is formed on the movable contact.

According to the first aspect, an arc is generated between the movable contact and pair of fixed contacts when the contacts are opened and the movable contact separates from the pair of fixed contacts. At this time, as the arc root movement promotion portion is formed on the movable contact, it is possible, using the arc root movement promotion portion, to cause the root of the generated arc to move in a direction away from the fixed contacts without remaining in a corner portion. Consequently, the electrical field intensity when the arc is generated increases, and it is possible to suppress regeneration of the arc, and thus to improve interruption performance.

Also, a second aspect of the contact device according to the invention is such that the arc root movement promotion portion is configured of an inclined surface in which a thickness decreases toward an end portion in a direction perpendicular to a current flow direction of the movable contact.

According to the second aspect, an inclined surface, such as a tapered surface or arc-like surface, in which a thickness decreases with proximity to a stepped portion is formed in a direction perpendicular to the current flow direction of the movable contact, because of which downward movement of an arc root is promoted along the inclined surface.

Also, a third aspect of the contact device according to the invention is such that the inclined surface is configured of a tapered surface.

According to the third aspect, the inclined surface is a tapered surface, because of which a movable contact having an arc root movement promotion portion can be formed easily.

Also, a fourth aspect of the contact device according to the invention is such that the inclined surface is configured of an arc-like curved surface.

According to the fourth aspect, the inclined surface is an arc-like curved surface, because of which there is no occurrence of a corner portion before reaching the bottom surface side of the movable contact, and arc root movement can be carried out easily and reliably.

Also, a fifth aspect of the contact device according to the invention is such that the arc root movement promotion portion is configured of an arc runner that is formed on an end surface of the movable contact perpendicular to the current flow direction of the movable contact and protrudes extending to the side opposite to that of the pair of fixed contacts.

According to the fifth aspect, an arc runner is provided as the arc root movement promotion portion, and the arc runner protrudes extending to the side of the movable contact opposite to that of the pair of fixed contacts. Because of this, the root of an arc generated when the contacts are opened is moved in a direction away from the fixed contacts without remaining in a corner portion, because of which the electrical field intensity when an arc is generated is increased, suppressing arc regeneration, and it is thus possible to improve interruption performance.

Also, a sixth aspect of the contact device according to the invention is such that the arc runner is formed so as to cover a side surface of the movable contact.

According to the sixth aspect, when the root of an arc generated when the contacts are opened reaches a corner portion of the movable contact, the arc root is reliably moved downward along the arc runner, and it is thus possible to improve interruption performance.

Also, a seventh aspect of the contact device according to the invention is such that the arc runner is such that a protruding portion on the side of the movable contact opposite to that of the pair of fixed contacts is inclined inward.

The seventh aspect is such that, as the arc runner is inclined inward on the side of the movable contact opposite to that of the fixed contacts, the arc root can be spread to the lower side of the movable contact, and it is thus possible to enlarge the arc extinguishing space, carrying out effective utilization of capacity.

Also, an eighth aspect of the contact device according to the invention is such that the arc runner is such that a protruding portion on the side of the movable contact opposite to that of the pair of fixed contacts is inclined outward.

According to the eighth aspect, the arc runner is inclined outward on the lower side of the movable contact, because of which it is possible to extend the arc root in a direction in which it spreads easily, thus increasing the distance from the fixed contact arc root.

Also, a ninth aspect of the contact device according to the invention is such that the arc runner is such that a protruding portion protrudes outwardly from the side of the movable contact opposite to that of the pair of fixed contacts.

According to the ninth aspect, it is possible to spread the arc root outward using the arc runner, thus increasing the distance from the fixed contact arc root.

Also, a first aspect of an electromagnetic switch according to the invention includes the contact device of the heretofore described first to ninth aspects, wherein the movable contact is coupled to a movable iron core of an electromagnet device, and the fixed contacts are connected to an external connection terminal.

According to this configuration, it is possible to provide an electromagnetic switch such that it is possible to reliably extinguish an arc generated when the contacts are opened, thus improving interruption performance, with a simple configuration.

Advantageous Effects of Invention

According to the invention, an arc root movement promotion portion that moves the root of an arc generated when the contacts are opened in a direction away from fixed contacts is formed on a movable contact. Because of this, it is possible to reliably prevent an arc generated when the contacts are opened from remaining in a corner portion of the movable contact, the electrical field intensity between the arc roots from dropping to or below the arc voltage, and arc regeneration from occurring between electrodes in the vicinity of the arc roots, and thus possible to improve interruption performance.

Also, by a contact device having the heretofore described advantage being applied to an electromagnetic switch, it is possible to provide an electromagnetic switch, such as an electromagnetic contactor or electromagnetic relay, such that it is possible to easily extinguish an arc generated when the contacts are opened, thus improving interruption performance, with a simple configuration.

BRIEF DESCRIPTION OF DRAWINGS

FIG. 4(*b*) is a plan view showing an orientation of the magnetic flux; and FIG. 4(*c*) is a plan view showing a large Lorentz force acting toward the arc extinguishing space.

DESCRIPTION OF EMBODIMENTS

Hereafter, based on the drawings, a description will be given of embodiments of the invention.

Figure 1:
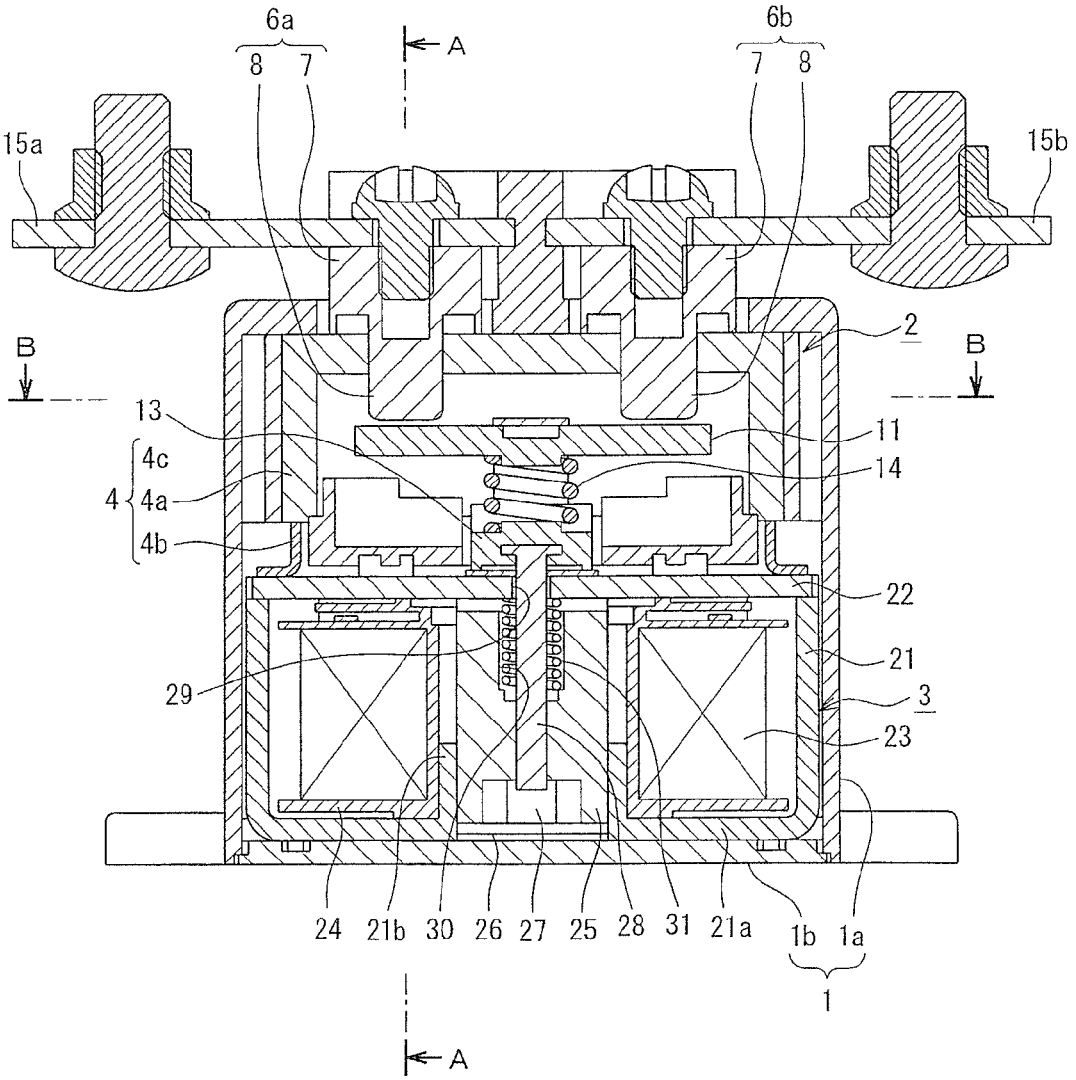
FIG. 1 is a sectional view showing a first embodiment when the invention is applied to an electromagnetic contactor.

FIG. 1 is a sectional view showing an example of a case wherein a contact device of the invention is applied to an electromagnetic contactor acting as an electromagnetic switch. In FIG. 1, reference 1 is an exterior case made of, for example, a synthetic resin. The exterior case 1 is configured of a bottomed tubular body 1*a*, of which the lower end surface is opened, and a bottom plate 1*b* that closes off the lower end surface of the bottomed tubular body 1*a*.

A contact device 2 in which is disposed a contact mechanism, and an electromagnet unit 3 acting as an electromagnet device that drives the contact device 2, are housed inside the exterior case 1 with a relationship such that the electromagnet unit 3 is disposed on the bottom plate 1*b*.

Figure 2:
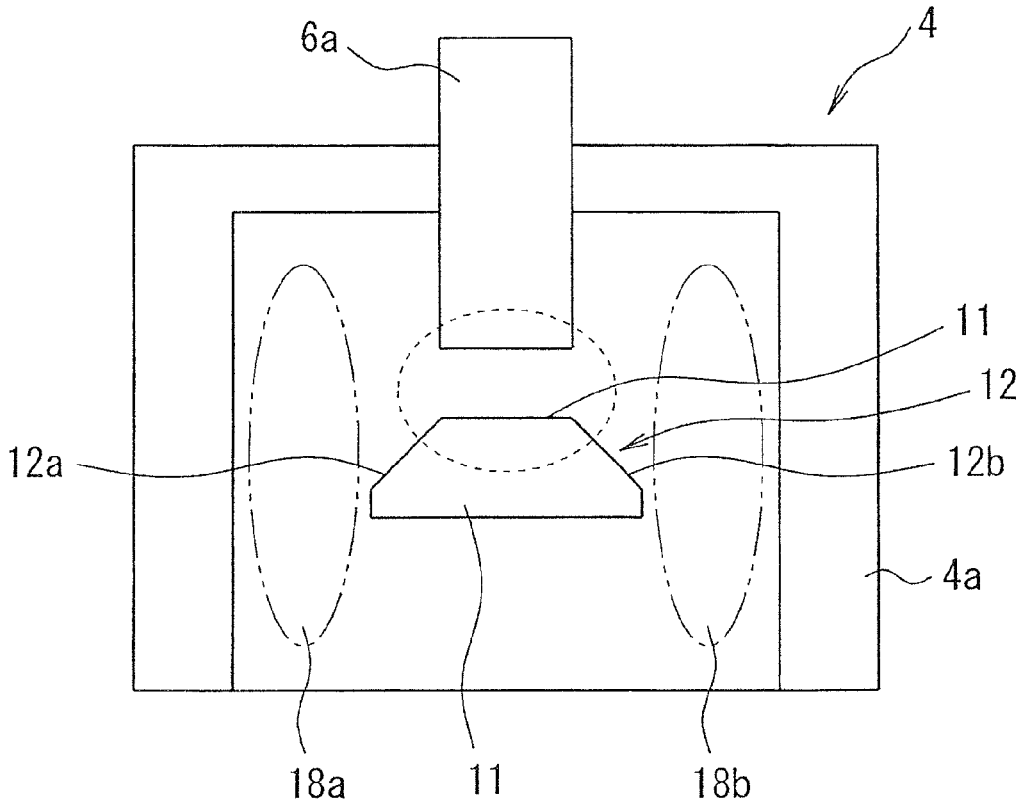
FIG. 2 is a schematic sectional view along the line A-A of FIG. 1.
Figure 3:
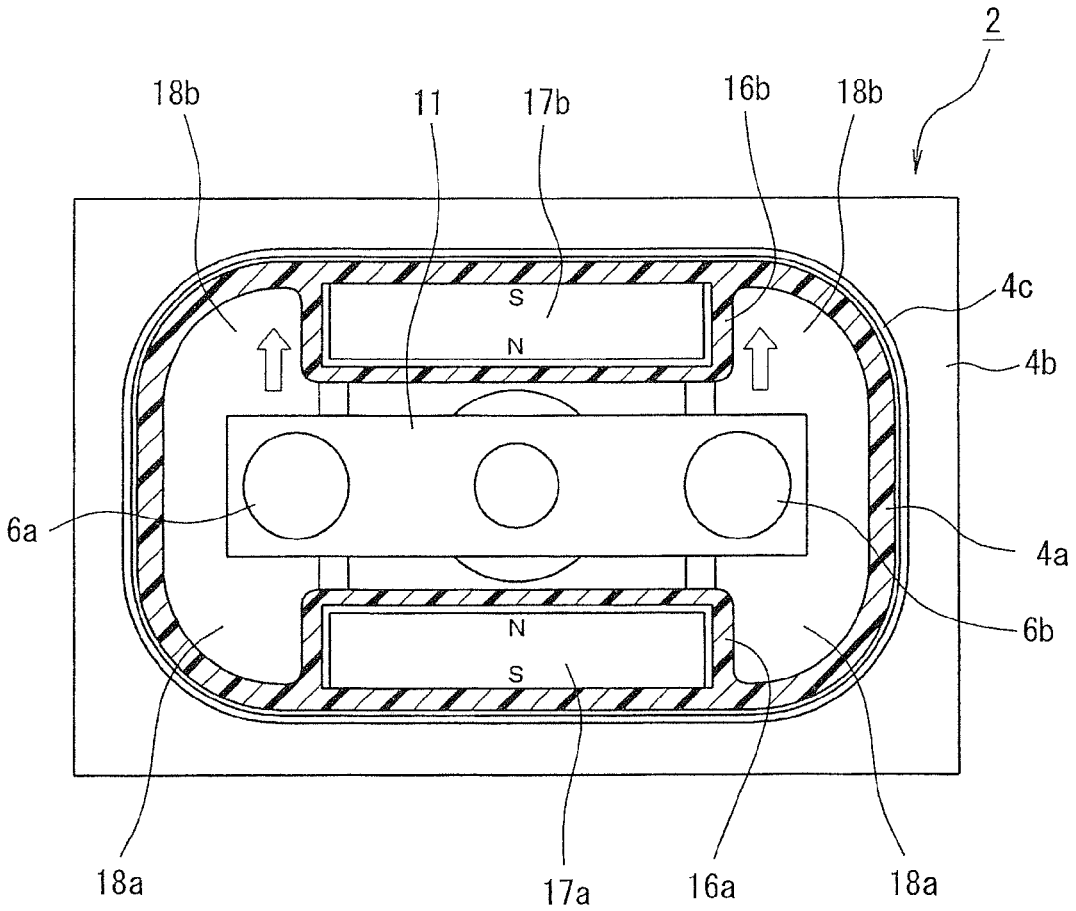
FIG. 3 is a sectional view along the line B-B of FIG. 1.

The contact device 2 has an arc extinguishing chamber 4, wherein the arc extinguishing chamber 4 is configured of a tub-form body 4*a* formed of a ceramic, a synthetic resin, or the like, the lower end of which is opened, a metal joining member 4*b* fixed in a hermetic state to the opened end surface, and a metal tubular body 4*c* that covers the side surfaces of the tub-form body 4*a*, as illustrated in FIG. 2 and FIG. 3. Further, the joining member 4*b* is fixed in a hermetic state by brazing, welding, or the like, to the upper surface of an upper magnetic yoke 22 of the electromagnet unit 3.

Through holes 5*a* and 5*b* of a circular form in cross-section are provided maintaining a predetermined interval in a longitudinal direction in the upper surface of the tub-form body 4*a*, and a pair of fixed contacts 6*a* and 6*b* made of, for example, copper are inserted through the through holes 5*a* and 5*b* and fixed by brazing, adhesive, or the like.

Each of the fixed contacts 6*a* and 6*b* is configured of an upper side large diameter head portion 7 and a lower side small diameter columnar portion 8 coaxially connected to the large diameter head portion 7.

The fixed contacts 6*a* and 6*b* are fixed by brazing, adhesive, or the like, to the tub-form body 4*a*, in a state wherein the small diameter columnar portions 8 are inserted through the through holes 5*a* and 5*b* of the tub-form body 4*a*, so as to seal the through holes 5*a* and 5*b*.

Also, the contact device 2 is such that a movable contact 11 is disposed so as to be capable of contacting to and separating from the opposing lower end surfaces of the small diameter columnar portions 8 of the fixed contacts 6*a* and 6*b* across a comparatively narrow predetermined gap. The movable contact 11 is such that a flat surface 11*a* is formed at least in a position opposing the fixed contacts 6*a* and 6*b*, as shown in FIG. 2. Also, an arc root movement promotion portion 12 is formed on the movable contact 11 in directions of the flat surface 11*a* perpendicular to the longitudinal direction of the movable contact 11, that is, on front and back end portion sides. The arc root movement promotion portion 12 is configured of inclined surfaces, that is, tapered surfaces 12*a* and 12*b*, whose thickness gradually decreases from the front and back end portions of the flat surface 11*a* toward the front and back end portions of the movable contact 11.

Further, the movable contact 11 is mounted in a contact holder 13 and urged upward by a contact spring 14. The contact holder 13 is coupled to a movable iron core 25 of the electromagnet unit 3, to be described hereafter, and driven in a vertical direction.

Furthermore, external connection terminal plates 15*a* and 15*b* are screwed to the large diameter head portions 7 of the fixed contacts 6*a* and 6*b*.

Also, magnet housing tubular portions 16*a* and 16*b* are formed on inner peripheral surfaces facing side surfaces of the tub-form body 4*a* perpendicular to the longitudinal direction of the movable contact 11, as shown in FIG. 3, and arc extinguishing permanent magnets 17*a* and 17*b* are housed inside the magnet housing tubular portions 16*a* and 16*b*. The arc extinguishing permanent magnets 17*a* and 17*b* are magnetized so that mutually facing inner peripheral surface sides are N poles, while outer peripheral surface sides are S poles.

Further, spaces to the left and right of the magnet housing tubular portions 16*a* and 16*b* form arc extinguishing spaces 18*a* and 18*b* respectively.

Further, a gas such as hydrogen gas, nitrogen gas, a mixed gas of hydrogen and nitrogen, air, or $SF_6$ is encapsulated inside the arc extinguishing chamber 4 configured of the tub-form body 4*a*, joining member 4*b*, and metal tubular body 4*c*.

The electromagnet unit 3 has a magnetic yoke 21 of a U-form when seen from the side, and a cylindrical portion 21*b* of which the lower end is opened is formed in a central portion of a bottom plate portion 21*a* of the magnetic yoke 21. The upper surface sides of the magnetic yoke 21 are connected by the upper magnetic yoke 22.

A coil holder 24, in which an exciting coil 23 is mounted wound, is mounted on the outer peripheral surface of the cylindrical portion 21*b* of the magnetic yoke 21, and a bottomed cylindrical cap 26, inside which the movable iron core 25 is slidably mounted, is disposed on the inner peripheral surface of the cylindrical portion 21*b*. A rubber seat 27, which contacts the bottom surface of the movable iron core 25 and absorbs impact when the movable iron core 25 descends, is disposed on the bottom surface of the cap 26.

A coupling shaft 28 is fitted in a central portion of the movable iron core 25, and a head portion of the coupling shaft 28 extends upward through a through hole 29 formed in the upper magnetic yoke 22, and is coupled to the contact holder 13.

Also, a spring insertion hole 30 is formed around the coupling shaft 28 of the movable iron core 25, and a return spring 31 that urges the movable iron core 25 downward is mounted between the spring insertion hole 30 and the upper magnetic yoke 22.

Next, a description will be given of an operation of the heretofore described embodiment.

Herein, it is assumed that the external connection terminal plate 15*a* is connected to, for example, a power supply source that supplies a large current, while the external connection terminal plate 15*b* is connected to a load.

In this state, the exciting coil 23 in the electromagnet unit 3 is in a non-conductive state, and no exciting force causing the movable iron core 25 to move is being generated in the electromagnet unit 3. In this state, the movable iron core 25 is urged in a downward direction away from the upper magnetic yoke 22 by the return spring 31, attaining a state wherein it is contacting the rubber seat 27. Because of this, the movable contact 11 supported by the contact holder 13 coupled to the movable iron core 25 via the coupling shaft 28 faces the lower end surfaces of the small diameter columnar portions 8 of the fixed contacts 6*a* and 6*b* across a predetermined gap, and the contact device 2 is in an opened contact (released) state.

On energizing the exciting coil 23 of the electromagnet unit 3 in the opened contact state of the contact device 2, an exciting force is generated in the electromagnet unit 3, and the movable iron core 25 is pressed upward against the return spring 31. In response to this, the contact holder 13 coupled via the coupling shaft 28 to the movable iron core 25 moves upward, and the movable contact 11 contacts the bottom surfaces of the small diameter columnar portions 8 of the fixed contacts 6*a* and 6*b* with the contact pressure of the contact spring 14.

Because of this, there is a closed contact (engaged) state wherein a large current i of the external power supply source is supplied to the load via the external connection terminal plate 15*a*, the fixed contact 6*a*, the movable contact 11, the fixed contact 6*b*, and the external connection terminal plate 15*b*.

When interrupting the supply of current to the load in the closed contact state of the contact device 2, the application of voltage to the exciting coil 23 of the electromagnet unit 3 is stopped.

Because of this, there is no longer an exciting force in the electromagnet unit 3 causing the movable iron core 25 to move upward, because of which the movable iron core 25 descends due to the urging force of the return spring 31. By the movable iron core 25 descending, the contact holder 13 coupled via the coupling shaft 28 descends. The movable contact 11 is contacting the fixed contacts 6*a* and 6*b* while the contact spring 14 is applying contact pressure in accordance with the descent of the contact holder 13. Subsequently, an opened contact state wherein the movable contact 11 separates downward from the fixed contacts 6*a* and 6*b* is created at the point at which there ceases to be contact pressure from the contact spring 14.

On the opened contact state being created, an arc is generated between the fixed contacts 6*a* and 6*b* and movable contact 11. At this time, the facing magnetic pole faces of the arc extinguishing permanent magnets 17*a* and 17*b* are N-poles, and the outer sides thereof are S-poles. Because of this, magnetic flux emanating from the N-poles, seen in plan view as shown in FIG. 4(*a*), crosses an arc generation portion of a portion in which the arc extinguishing permanent magnets 17*a* and 17*b* and fixed contact 6*a* and the movable contact 11 are opposed, from the inner side to the outer side in the longitudinal direction of the movable contact 11, and reaches the S-pole, whereby a magnetic field is formed.

In the same way, the magnetic flux crosses an arc generation portion of the contact portion of the fixed contact 6*b* and the contact portion of the movable contact 11, from the inner side to the outer side in the longitudinal direction of the movable contact 11, and reaches the S-pole, whereby a magnetic field is formed.

Consequently, the magnetic fluxes of the arc extinguishing permanent magnets 17*a* and 17*b* both cross between the fixed contact 6*a* and movable contact 11 and between the fixed contact 6*b* and movable contact 11 in mutually opposite directions in the longitudinal direction of the movable contact 11.

Figure 4A:
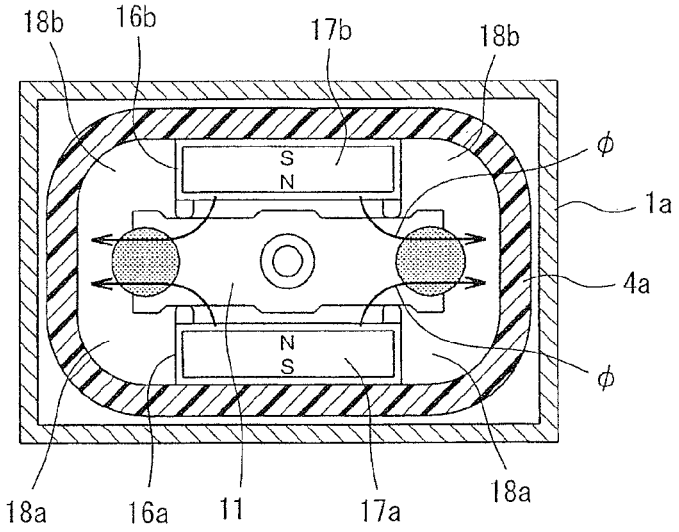
FIGS. 4(*a*)-4(*c*) are illustrations accompanying a description of arc extinguishing by an arc extinguishing permanent magnet, in which FIG. 4*a*) is a plan view showing a magnetic flux emanating from the N-poles.
Figure 4B:
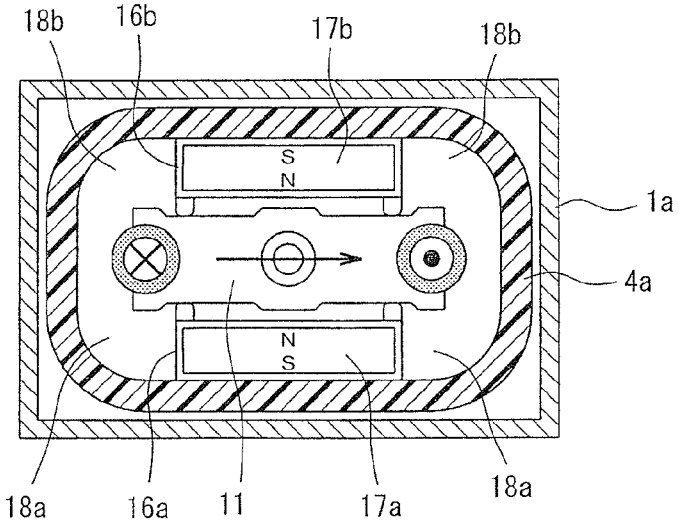
Figure 4C:
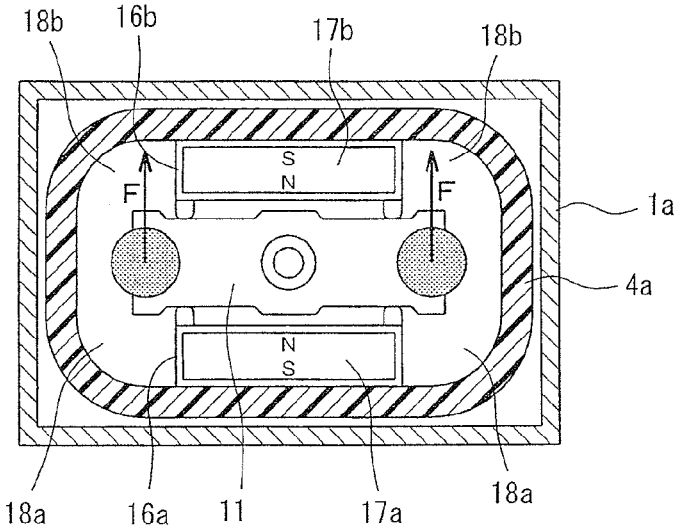

Because of this, a current I flows from the fixed contact 6*a* side to the movable contact 11 side (to the upper surface side) between the fixed contact 6*a* and movable contact 11, and the orientation of a magnetic flux $\phi$ is in a leftward direction from the inner side toward the outer side, as shown in FIG. 4(*b*). Because of this, in accordance with Fleming's left-hand rule, a large Lorentz force F acts toward the arc extinguishing space 18*b* side, perpendicular to the longitudinal direction of the movable contact 11 and perpendicular to the switching direction of the fixed contact 6*a* and movable contact 11, as shown in FIG. 4(*c*).

Due to the Lorentz force F, an arc generated between the fixed contact 6*a* and movable contact 11 is greatly extended so as to pass from the side surface of the fixed contact 6*a* through the inside of the arc extinguishing space 18*b*, reaching the lower surface side of the movable contact 11, and is extinguished.

Also, at the lower side and upper side of the arc extinguishing space 18*b*, the orientation of the magnetic flux between the fixed contact 6*a* and movable contact 11 is uniform, while current orientation differs due to the extension of the arc. Because of this, the arc extended to the arc extinguishing space 18*b* is further extended in the direction of the corner of the arc extinguishing space 18*b* due to the current orientation, it is possible to increase the arc length, and thus possible to obtain good interruption performance.

Meanwhile, the current I flows from the movable contact 11 side to the fixed contact 6*b* side, and flows toward the front, between the fixed contact 6*b* and the movable contact 11, and the orientation of the magnetic flux $\phi$ is in a rightward direction from the inner side toward the outer side, as shown in FIG. 4(*b*). Because of this, in accordance with Fleming's left-hand rule, a large Lorentz force F acts toward the arc extinguishing space 18*b*, perpendicular to the longitudinal direction of the movable contact 11 and perpendicular to the switching direction of the fixed contact 6*b* and movable contact 11, as shown in FIG. 4(*c*).

Due to the Lorentz force F, an arc generated between the fixed contact 6*b* and movable contact 11 is greatly extended so as to pass from the upper surface side of the movable contact 11 through the inside of the arc extinguishing space 18*b*, reaching the side surface side of the fixed contact 6*b*, and is extinguished.

Also, at the lower side and upper side of the arc extinguishing space 18*b*, as heretofore described, the orientation of the magnetic flux between the fixed contact 6*a* and movable contact 11 is uniform, while current orientation differs due to the extension of the arc. Because of this, the arc extended to the arc extinguishing space 18*b* is further extended in the direction of the corner of the arc extinguishing space 18*b* due to the current orientation, it is possible to increase the arc length, and thus possible to obtain good interruption performance.

Meanwhile, when adopting a released state in a state wherein a regenerative current flows from the load side to the direct current power source side in the closed contact (engaged) state of the electromagnetic contactor 10, the direction of current in FIG. 4(*b*) is reversed, meaning that the Lorentz force F acts on the arc extinguishing space 18*a* side, and excepting that the arc is extended to the arc extinguishing space 18*a* side, the same arc extinguishing function is fulfilled.

At this time, as the arc extinguishing permanent magnets 17*a* and 17*b* are disposed in the magnet housing tubular portions 16*a* and 16*b* formed in the tub-form body 4*a* of the arc extinguishing chamber 4, the arc does not directly contact the arc extinguishing permanent magnets 17*a* and 17*b*. Because of this, it is possible to stably maintain the magnetic characteristics of the arc extinguishing permanent magnets 17*a* and 17*b*, and thus possible to stabilize interruption performance.

Further, when the movable contact 11 starts to separate from the fixed contacts 6*a* and 6*b* and an arc is generated, the arc is extended by the magnetic force of the arc extinguishing permanent magnets 17*a* and 17*b* to the arc extinguishing space 18*a* or 18*b*, depending on the current orientation, as previously described.

At this time, the arc root movement promotion portion 12 is formed on the side surface sides of the movable contact 11. Because of this, when the arc is extended by the magnetic force of the arc extinguishing permanent magnets 17*a* and 17*b* to the arc extinguishing space 18*a* or 18*b*, the tapered surface 12*a* or 12*b* formed on the movable contact 11 has the effect that an arc root moves to the outer side and downward along the tapered surface 12*a* or 12*b* from positions facing the fixed contacts 6*a* and 6*b*.

Consequently, the distance between the arc root of the tapered surface 12*a* or 12*b* of the movable contact 11 and the other root of the arc formed on the fixed contact 6*a* or 6*b* increases, and not being affected by metal vapor or the like, electrical field intensity increases. Because of this, it is possible to reliably prevent the arc from being regenerated between electrodes in the vicinity of the arc root of the movable contact 11, and thus possible to improve interruption performance.

Incidentally, assuming for the moment that the movable contact 11 is a flat surface on which the tapered surfaces 12*a* and 12*b* are not formed, the movable contact 11 side arc root of an arc generated between the movable contact 11 and fixed contacts 6*a* and 6*b* remains in a corner portion of the flat surface and a side surface when the arc root is extended to the arc extinguishing space 18*b* side by the magnetic force of the arc extinguishing permanent magnets 17*a* and 17*b*. Because of this, when the arc root stops with the distance from the arc root of the fixed contacts 6*a* and 6*b* still short, the electrical field intensity between the arc roots may drop to or below the arc voltage due to metal vapor or the like. As a result of this, the arc is regenerated between electrodes in the vicinity of the arc root, and interruption performance falls.

At this time, by increasing the size of the arc extinguishing space on the lower side of the movable contact 11, the arc root more easily moves to the surface of the movable contact 11 on the side opposite to that of the fixed contacts 6*a* and 6*b*, and is more easily extended, thus, it is possible to further improve interruption performance.

In this way, according to the first embodiment, the arc root movement promotion portion 12 formed of the tapered surfaces 12*a* and 12*b* is formed on the side surface sides perpendicular to the longitudinal direction of the movable contact 11, because of which the movable contact side root of an arc generated when the contacts are opened and the movable contact 11 separates from the fixed contacts 6*a* and 6*b* can easily be moved along the tapered surface 12*a* (or 12*b*). Because of this, the distance between arc roots occurring between the movable contact 11 and fixed contacts 6*a* and 6*b* is increased, electrical field intensity increases, and it is thus possible to prevent arc regeneration, accelerate arc extinguishing, and improve interruption performance.

Furthermore, by arc extinguishing being carried out adequately, it is possible to reduce the gap between the fixed contacts 6*a* and 6*b* and movable contact 11, and possible to shorten the time for which the contacts are opened, interrupting the current.

Figure 5:
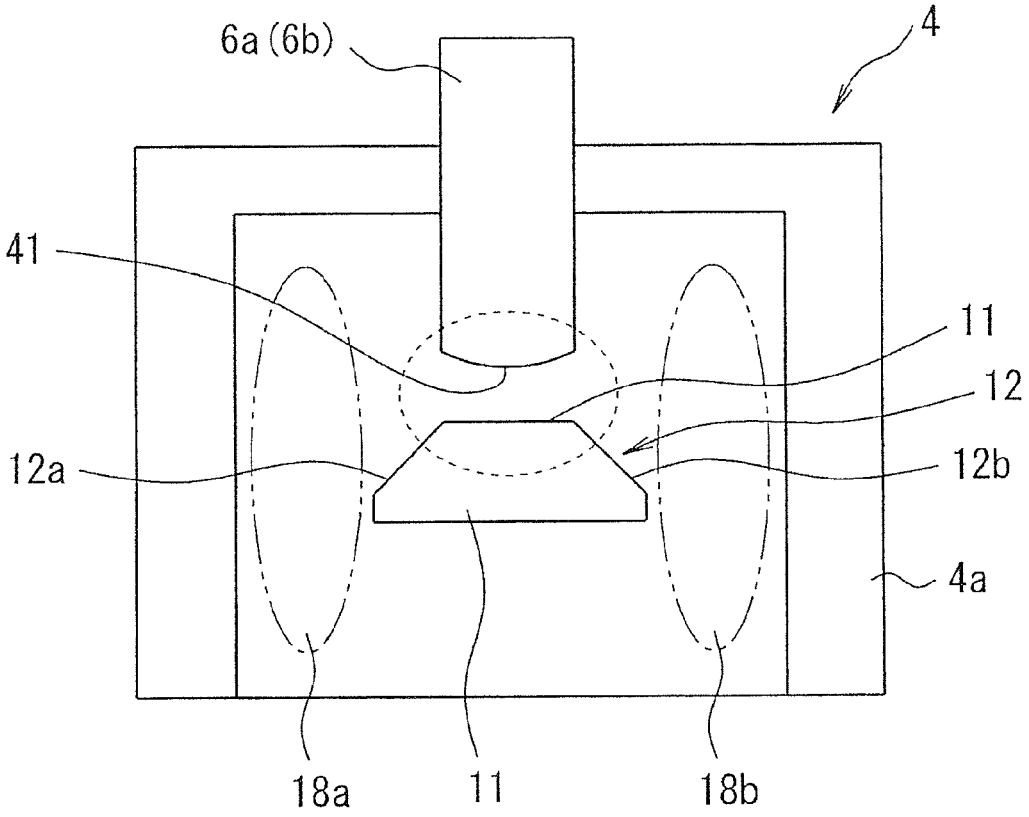
FIG. 5 is a schematic sectional view showing a modification example of the first embodiment of the invention.

In the first embodiment, a description has been given of a case wherein the regions of the fixed contacts 6*a* and 6*b* facing the movable contact 11 are the small diameter columnar portions 8 but, not being limited to this, the contact portions of the fixed contacts 6*a* and 6*b* facing the movable contact 11 may also be formed of curved surfaces 41 of a spherical surface form or cylindrical surface form, as shown in FIG. 5. In this case, the arc root also moves to the upper side on the fixed contacts 6*a* and 6*b* side, it is possible to increase the distance between arc roots, and possible to more reliably extinguish the arc, thus further improving interruption performance.

Figure 6:
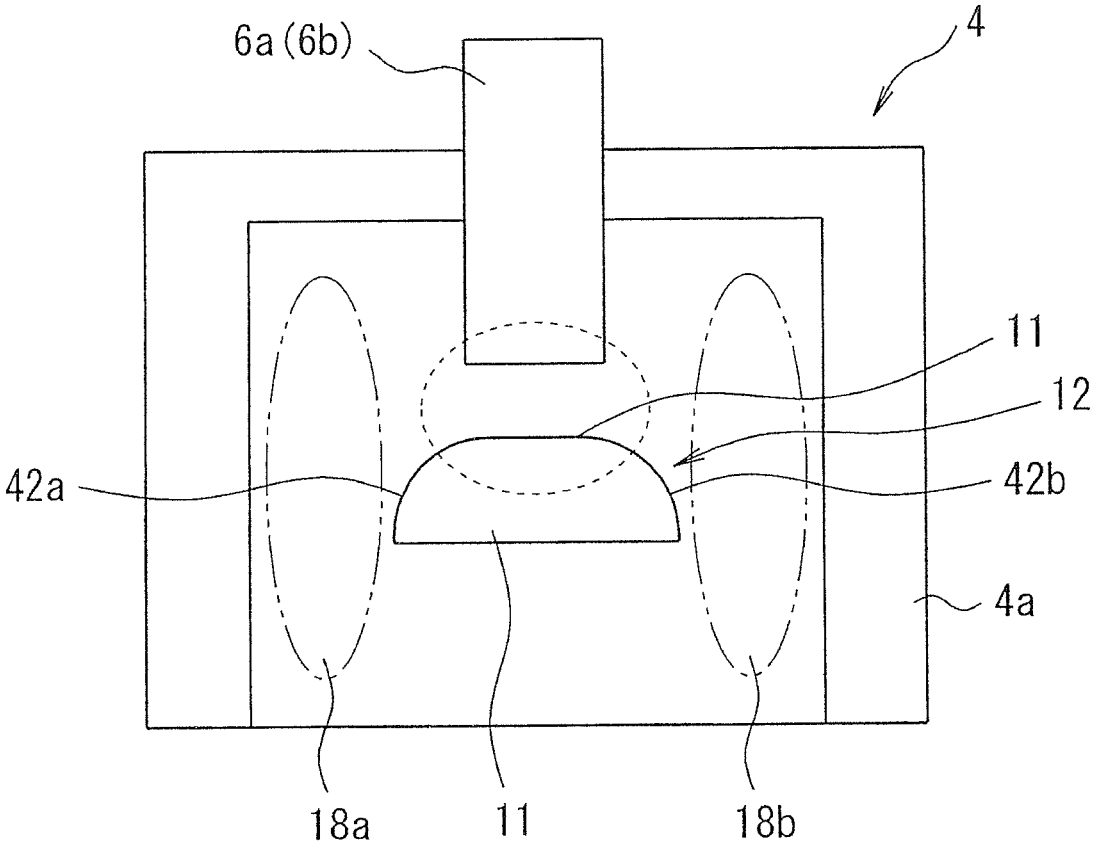
FIG. 6 is a schematic sectional view showing another modification example of the first embodiment of the invention.

Also, in the first embodiment, a description has been given of a case wherein the arc root movement promotion portion 12 is formed into the tapered surfaces 12*a* and 12*b* but, not being limited to this, arc-like curved surfaces 42*a* and 42*b* forming one portion of a cylindrical surface may be adopted, as shown in FIG. 6. In this case, it is possible to increase the distance from the arc roots of the fixed contacts 6*a* and 6*b* as the arc roots move to the outer side along the arc-like curved surfaces 42*a* and 42*b*, and thus possible to further improve interruption performance.

Next, a description will be given of a second embodiment of the invention, based on FIG. 7.

In the second embodiment, arc runners are provided in place of inclined surfaces as an arc root movement promotion portion.

Figure 7:
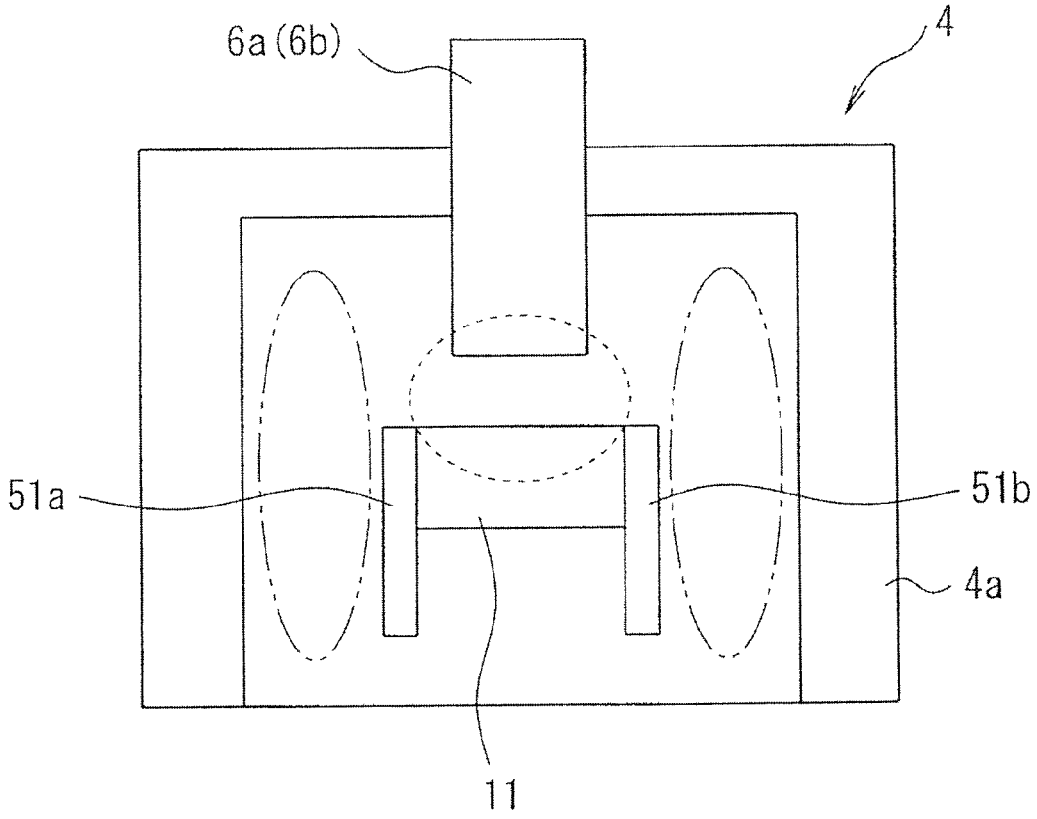
FIG. 7 is a schematic sectional view showing a second embodiment of the invention.
Figure 8:
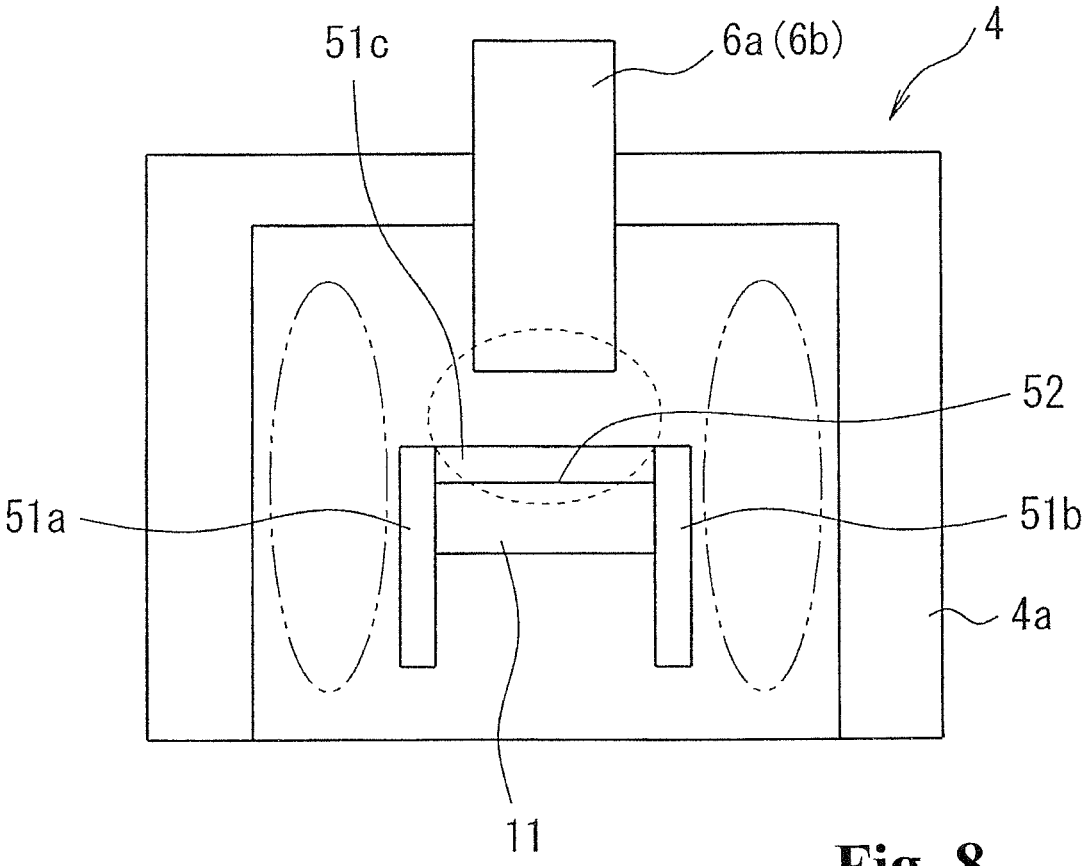
FIG. 8 is a schematic sectional view showing a first modification example of the second embodiment of the invention.

That is, in the second embodiment, as shown in FIG. 7, arc runners 51*a* and 51*b* are fixed covering side surfaces in a direction perpendicular to the longitudinal direction of the movable contact 11, which is of rectangular sectional form, and extending below the lower surface of the movable contact 11. Herein, each of the arc runners 51*a* and 51*b* may be formed of a metal material that has arc resistance, such as tungsten (W) or silver (Ag), or has conductivity, such as copper (Cu).

Regarding other configurations, the second embodiment has the same configurations as the first embodiment, the same reference numbers are given to portions corresponding to FIG. 2, and a detailed description thereof will be omitted.

According to the second embodiment, an arc generated between the movable contact 11 and fixed contacts 6*a* and 6*b* when the contacts are opened and the movable contact 11 separates from the fixed contacts 6*a* and 6*b* is extended to the arc extinguishing space 18*a* (or 18*b*) side by the magnetic force of the arc extinguishing permanent magnets 17*a* and 17*b*, in the same way as in the first embodiment.

At this time, the movable contact 11 side arc root moves to the side surface arc runner 51*a* (or 51*b*) side in accordance with being extended to the arc extinguishing space 18*a* (or 18*b*) side, and when the arc root reaches the arc runner 51*a* (or 51*b*), it moves swiftly downward along the arc runner 51*a* (or 51*b*). Because of this, the arc root does not remain in a corner portion of a side surface of the movable contact 11, and it is possible to increase the distance from the arc root of the fixed contacts 6*a* and 6*b*, thus preventing a decrease in electrical field intensity caused by a metal vapor or the like. Consequently, it is possible to easily extinguish the arc, thus improving interruption performance.

In the second embodiment, a description has been given of a case wherein the arc runners 51*a* and 51*b* are formed so as to cover the side surfaces of the movable contact 11 but, not being limited to this, upper end portions of the two arc runners 51*a* and 51*b* may be coupled by a coupling portion 51*c*, forming an inverted U-shape in cross-section. In this case, a groove portion 52 extending in the front-back direction is formed in the surface of the movable contact 11 facing the fixed contacts 6*a* and 6*b*, and the coupling portion 51*c* is fitted into and fixed in the groove portion 52. By the arc runner being formed in an inverted U-shape in this way, the movement of the arc root along the coupling portion 51*c* can be carried out smoothly, and the fixing of the arc runner to the movable contact 11 can be carried out easily.

Figure 9:
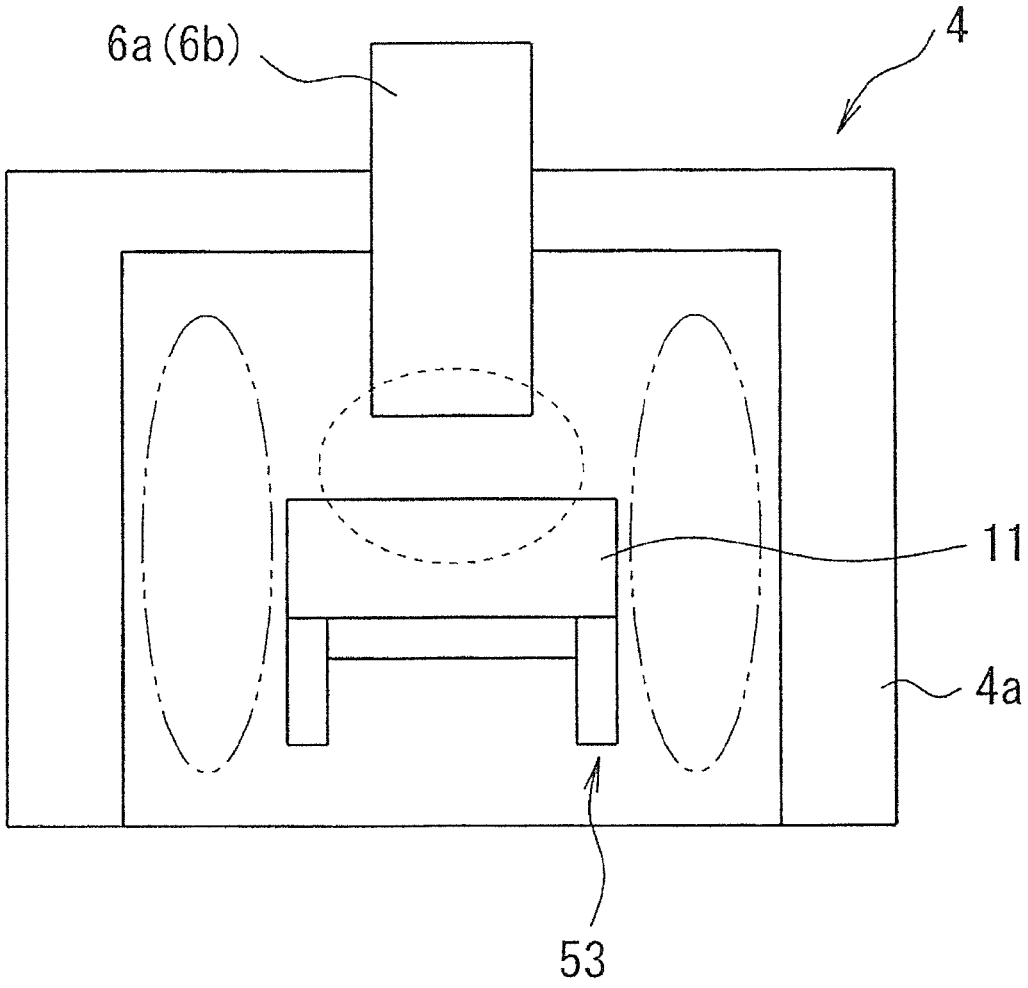
FIG. 9 is a schematic sectional view showing a second modification example of the second embodiment of the invention.

Also, as shown in FIG. 9, the arc runner 53 formed in an inverted U-shape may also be fixed on the lower surface side of the movable contact 11. In this case too, the arc is extended by the arc extinguishing permanent magnets 17*a* and 17*b*, and when reaching a side surface side end portion of the movable contact 11, the arc root is drawn to the arc runner 53 formed on the lower surface side without remaining in the end portion. Because of this, the distance between the movable contact 11 side arc root and fixed contacts 6*a* and 6*b* arc root is increased, and it is possible to increase the electrical field intensity between the arc roots, thus improving interruption performance.

Figure 10:
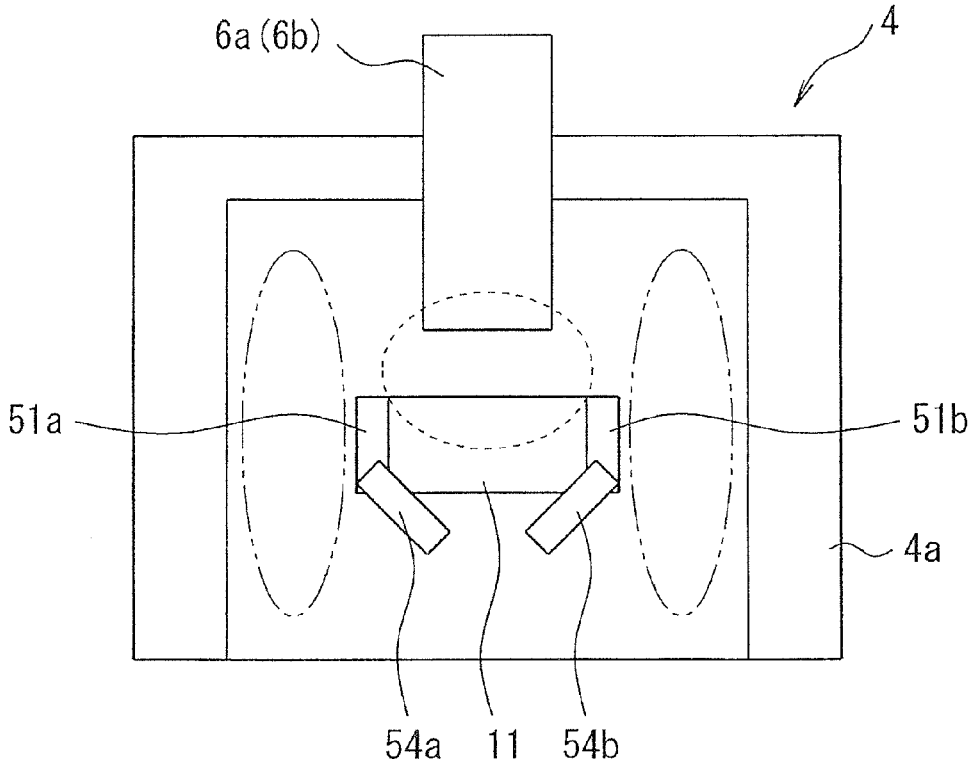
FIG. 10 is a schematic sectional view showing a third modification example of the second embodiment of the invention.

Furthermore, as shown in FIG. 10, arc runners 54*a* and 54*b* on the lower surface side of the movable contact 11 may be caused to incline inward by being bent inward. In this case, it is possible to cause the movable contact 11 arc root to move to the lower surface side of the movable contact 11, possible to use the lower side of the movable contact 11 as an arc extinguishing space, and thus possible to easily extinguish the arc by increasing the length by which the arc is extended, and to achieve an efficient utilization of the capacity.

Figure 11:
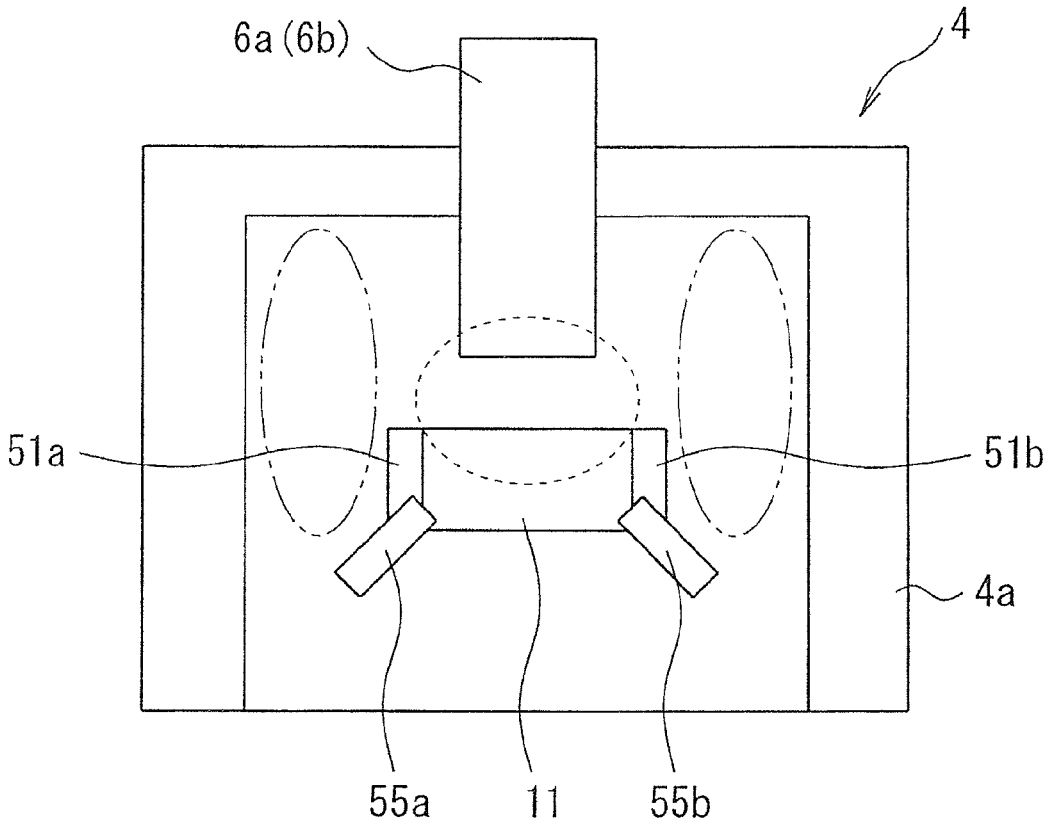
FIG. 11 is a schematic sectional view showing a fourth modification example of the second embodiment of the invention.

Also, as shown in FIG. 11, arc runners 55*a* and 55*b* on the lower side of the movable contact 11 may be caused to incline outward by being bent outward, which is the reverse of FIG. 10. In this case, it is possible to cause the arc root to move in a direction such that the arc spreads easily on the lower surface side of the movable contact 11. It is possible to reliably carry out movement of the arc root, and thus easily carry out arc extinguishing.

Figure 12:
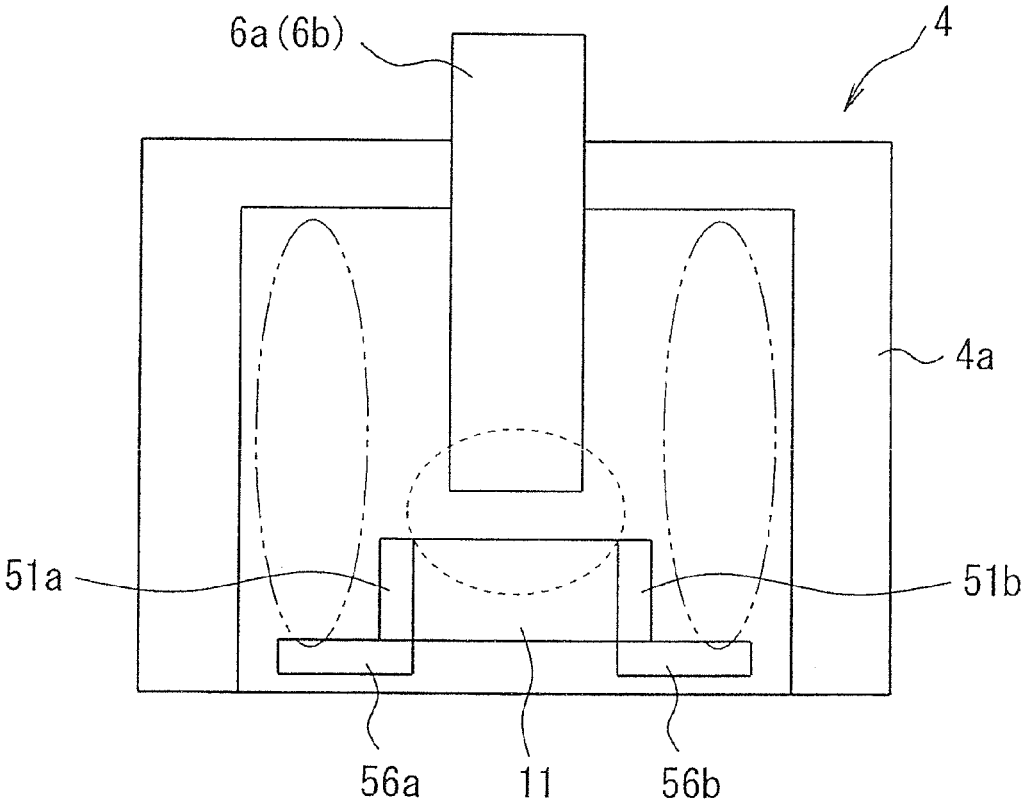
FIG. 12 is a schematic sectional view showing a fifth modification example of the second embodiment of the invention.

Furthermore, as shown in FIG. 12, arc runners 56*a* and 56*b* on the lower side of the movable contact 11 may be caused to protrude outward by being bent outward at right angles. In this case too, in the same way as in FIG. 11, it is possible to cause the arc root to move in a direction such that the arc spreads easily on the lower surface side of the movable contact 11, and possible to reliably carry out movement of the arc root, thus easily carrying out arc extinguishing.

Also, in the second embodiment too, the surfaces of the fixed contacts 6*a* and 6*b* facing the movable contact 11 may also be formed in a spherical surface form or cylindrical surface form, in the same way as in the first embodiment.

Also, in the first and second embodiments, a description has been given of a case wherein the arc extinguishing permanent magnets 17*a* and 17*b* are disposed on the inner side of the tub-form body 4*a* but, not being limited to this, the arc extinguishing permanent magnets 17*a* and 17*b* may be disposed parallel to the movable contact 11 on the outer side of the tub-form body 4*a*.

Also, in the first and second embodiments, a description has been given of a case wherein the arc extinguishing chamber 4 is configured of the tub-form body 4*a*, joining member 4*b*, and metal tubular body 4*c*, but, not being limited to this, an arbitrary configuration can be adopted, as an insulating tubular body may be disposed on the inner side of a metal tub-form body.

Furthermore, in the first and second embodiments, a description has been given of a case wherein gas is encapsulated in the arc extinguishing chamber 4, but, not being limited to this, the gas encapsulation may be omitted when the value of the interrupted current is small.

Also, in the first and second embodiments, a description has been given of a case wherein the form of the movable contact 11 is formed in a plate form in the longitudinal direction, but, not being limited to this, a central portion between the contact portions of the movable contact 11 facing the fixed contacts 6*a* and 6*b* may be formed in a depressed form or a protruding form.

Furthermore, in the first and second embodiments, a description has been given of a case wherein the movable contact 11 faces the fixed contacts 6*a* and 6*b* from the lower side but, not being limited to this, the contact portions of the fixed contacts 6*a* and 6*b* may be disposed on the lower side of the arc extinguishing chamber 4, and the movable contact 11 caused to face the contact portions from the upper side.

Furthermore, the configuration of the electromagnet unit 3 not being limited to that in the heretofore described embodiments either, an arbitrary configuration can be applied, provided that it is possible to cause the contact holder 13 to move by electromagnetic force.

Furthermore, in the heretofore described embodiments, a description has been given of a case wherein the contact device 2 of the invention is applied to an electromagnetic contactor but, not being limited to this, the invention is also applicable to any switch including an electromagnetic relay or other electromagnet switch.

INDUSTRIAL APPLICABILITY

According to the invention, an arc root movement promotion unit that causes the root of an arc generated when contacts are opened to move in a direction away from fixed contacts is formed in a movable contact. Because of this, it is possible to provide a contact device, and an electromagnetic switch in which the contact device is used, such that an arc generated between the fixed contacts and movable contact when the contacts are opened can be easily extinguished.

REFERENCE SIGNS LIST

1 . . . Exterior case, 2 . . . Contact device, 3 . . . Electromagnet unit, 4 . . . Arc extinguishing chamber, 4*a* . . . Tub-form body, 4*b* . . . Joining member, 4*c* . . . Metal tubular body, 6*a*, 6*b* . . . Fixed contact, 11 . . . Movable contact, 12 . . . Arc root movement promotion portion, 12*a*, 12*b* . . . Tapered surface, 13 . . . Contact holder, 14 . . . Contact spring, 15*a*, 15*b* . . . External connection terminal plate, 21 . . . Magnetic yoke, 22 . . . Upper magnetic yoke, 23 . . . Exciting coil, 24 . . . Coil holder, 25 . . . Movable iron core, 26 . . . Cap, 28 . . . Coupling shaft, 31 . . . Return spring, 51*a*, 51*b* . . . Arc runner, 51*c* . . . Coupling portion, 53 . . . Arc runner, 54*a*, 54*b*, 55*a*, 55*b*, 56*a*, 56*b* . . . Arc runner

What is claimed is:

1. A contact device, comprising:

a pair of fixed contacts fixedly disposed inside an arc extinguishing chamber and maintaining a predetermined interval from each other;

a movable contact disposed to be contacting to and separating from the pair of fixed contacts;

a pair of arc extinguishing permanent magnets sandwiching the movable contact along a longitudinal direction thereof for extending an arc in a direction perpendicular to a moving direction of the movable contact relative to the fixed contact; and an arc root movement promotion portion formed on the movable contact to promote a movement of root of arc in a direction away from the pair of fixed contacts, the root of arc being generated when the movable contact is opened and separates from the pair of fixed contacts, wherein the arc root movement promotion portion includes a pair of arc runners provided on two side surfaces of the movable contact extending in the longitudinal direction of the movable contact and protruding in a direction away from the pair of fixed contacts.

2. The contact device according to claim 1, wherein the arc runner has a protruding portion extending from and inclined inwardly to the movable contact at a side opposite to that of the pair of fixed contacts.

3. The contact device according to claim 1, wherein the arc runner has a protruding portion extending from and inclined outwardly to the movable contact at a side opposite to that of the pair of fixed contacts.

4. The contact device according to claim 1, wherein the arc runner has a protruding portion extending outwardly from the movable contact to be parallel to the movable contact at a side opposite to each of the pair of fixed contacts.

5. An electromagnetic switch, comprising:

a contact device according to claim 1, wherein the movable contact is coupled to a movable iron core of an electromagnet device, and the fixed contacts are connected to an external connection terminal.

6. The contact device according to claim 1, wherein the arc root movement promotion portion further includes a coupling portion disposed on an upper surface of the movable contact facing the pair of fixed contacts to couple the pair of arc runners and forming an inverted U-shape.

7. The contact device according to claim 6, wherein each arc runner of the pair of arc runners includes a protruding portion extending from the movable contact beyond a lower surface of the movable contact.

8. The contact device according to claim 1, wherein each arc runner of the pair of arc runners has an upper end aligned to an upper surface of the movable contact to cover a corresponding side surface of the pair of side surfaces of the movable contact and a protruding portion extending from the side surface of the movable contact beyond a lower surface of the movable contact.

9. The contact device according to claim 8, wherein the pair of protruding portions extends in parallel to each other.

10. The contact device according to claim 8, wherein the pair of arc extinguishing permanent magnets is disposed inside the arc extinguishing chamber, and each arc extinguishing permanent magnet of the pair of arc extinguishing permanent magnets extends between the pair of fixed contacts to form spaces at two sides of each of the pair of fixed contacts so that when the arc root moves along the arc runner, the arc extends to the spaces and is extinguished.

* * * * *